US009889387B2

(12) United States Patent
Roth

(10) Patent No.: US 9,889,387 B2
(45) Date of Patent: Feb. 13, 2018

(54) WATER PARCOURSE WITH A SUSPENSION SYSTEM

(71) Applicant: Uwe Roth, Karlsruhe (DE)

(72) Inventor: Uwe Roth, Karlsruhe (DE)

( * ) Notice: Subject to any disclaimer, the term of this patent is extended or adjusted under 35 U.S.C. 154(b) by 40 days.

(21) Appl. No.: 15/210,913

(22) Filed: Jul. 15, 2016

(65) Prior Publication Data

US 2018/0015380 A1 Jan. 18, 2018

(51) Int. Cl.

| | |
|---|---|
| ***A63B 24/00*** | (2006.01) |
| ***A63H 23/16*** | (2006.01) |
| ***A63B 21/00*** | (2006.01) |
| ***A63B 71/00*** | (2006.01) |

(52) U.S. Cl.

CPC ..... *A63H 23/16* (2013.01); *A63B 21/00069* (2013.01); *A63B 24/0087* (2013.01); *A63B 71/0054* (2013.01); *A63B 2208/03* (2013.01); *A63B 2210/00* (2013.01); *A63B 2225/093* (2013.01)

(58) Field of Classification Search

CPC . A63B 24/00; A63B 24/0062; A63B 24/0087; A63B 23/16; A63B 71/0054; A63B 2208/03; A63B 2210/00; A63B 2225/093

See application file for complete search history.

(56) References Cited

U.S. PATENT DOCUMENTS

| | | | | |
|---|---|---|---|---|
| 1,962,184 A * | 6/1934 | Eiserman | ..... | A63B 35/00 472/13 |
| 4,948,118 A * | 8/1990 | Miraglia | ..... | A61H 3/008 104/62 |
| 7,648,450 B2 * | 1/2010 | Munson, Jr. | ..... | A63B 21/0083 482/111 |

FOREIGN PATENT DOCUMENTS

DE 10 2010 036 009 3/2012

* cited by examiner

*Primary Examiner* — Glenn Richman
(74) *Attorney, Agent, or Firm* — Gudrun E. Huckett

(57) ABSTRACT

A water parcourse has a suspension system and exercise elements. Each exercise element is attached for arrangement in a predetermined position of use below, on, or above a water surface or in a predetermined rest position spaced apart from the water surface on the suspension system above the water surface. The exercise elements are movable from the position of use into a rest position and back. The suspension system is provided with at least one support structure and, arranged on the support structure, at least one of the components of a group that includes a shaft on which one or several winches are rotatably arranged; a pull rod system; and one or several deflection rollers, wherein for transfer of the exercise elements from the position of use into the rest position and back the support structure or the pull rod system can be changed in relation to a spatial position by means of at least one drive, with which the support structure or the pull rod system is in operative connection.

18 Claims, 4 Drawing Sheets

WATER PARCOURSE WITH A SUSPENSION SYSTEM

BACKGROUND OF THE INVENTION

The invention concerns a water parcourse with a suspension system wherein the water parcourse comprises exercise elements.

Water sports articles and devices that are used for forms of training in water such as water gymnastics are known in the prior art. Moreover, various forms of water toys are known that are designed to motivate playful activity in water.

A special form of such devices are water obstacles that are arranged in sequence and form a water parcourse. Such a water parcourse is disclosed in DE 10 2010 036 009 B4. This water parcourse may comprise different kinds of exercise elements that are provided for different types of utilization such as climbing up, climbing over, or diving through.

Based on this prior art, the object of the present invention is to provide a water parcourse with an improved suspension system that, when not in use, enables simple stowing of the water parcourse above the water surface.

SUMMARY OF THE INVENTION

This object is solved by a water parcourse with a suspension system with the features of claim 1.

Further embodiments of the water parcourse are disclosed in the dependent claims.

A first embodiment of the water parcourse according to the invention with a suspension system that comprises exercise elements relates to each of the exercise elements being attached to the suspension system for arrangement in a predetermined position of use or rest position above the water surface. The exercise elements can be transferred from the position of use into a rest position and back. In the position of use, the exercise elements are arranged underneath, on, or above a water surface and in the rest position at a spacing relative to the water surface; in the rest position, the exercise elements are positioned spaced apart from the water surface such that the latter can be utilized without impairment. According to the invention, the suspension system comprises at least one support structure. However, several support structures may also be used. As needed, one or several components such as a shaft on which one or several winch(es) are rotatably arranged, a pull rod system, or one or several deflection roller(s) are arranged on one or on several corresponding support structures. For transferring the exercise elements from the position of use into the rest position and back, the support structure or the pull rod system is changeable in relation to a spatial position by means of at least one drive with which the support structure or the pull rod system is in operative connection. When several support structures are present, of course several drives can also be correspondingly in operative connection therewith, at least one per support structure.

"Exercise elements" can be different water sports elements, water toys or training elements, of course also for preventive health care.

"Spatial position" means an unequivocal position in a spanned three-dimensional space.

An advantage of the suspension system according to the invention is that the water parcourse after use can be transferred into a rest position in which the water surface and the water are free from exercise elements and are available for another utilization. In this context, the water parcourse must not be taken down or tied in a complicated way.

In a further embodiment of the water parcourse with suspension system, it comprises ropes that are embodied to attach the exercise elements in a height-adjustable way on the support structure. In this way, advantageously an individual adjustment of the individual exercise elements to the respective desired height is possible. For example, an exercise element, for example, in order to achieve various degrees of difficulty, can be suspended at different heights.

The suspension system can be installed within a building and the support structure can be part of the roof of the building. In this case, the components of the suspension system can be attached to beams or struts of the ceiling.

"Building" means very generally any type of an enclosed or even only covered swimming area. By utilization of the already existing ceiling parts as a support structure an ideal utilization of the space can be achieved.

In a further embodiment of the suspension system, the rope extends from the exercise element to the winch. By rotating the shaft on which the winch is seated, the rope is shortened or lengthened. In this way, the exercise element is pulled up toward the winch or is released from it. This arrangement has the advantage that the travel length by which the exercise elements can be pulled up is independent of the space conditions adjacent to the water surface or adjacent to the suspension system. The rope is wound properly onto the winch and is thus properly stowed, independent of its length.

For arrangement at the desired position above the water surface, independent of the position of the shaft or winch, the ropes can be guided across deflection rollers so that an exercise element can also be positioned laterally displaced relative to the shaft. Suitably arranged deflection rollers can also provide advantages for force transmission. Whether deflection rollers are used, or how many, depends on the respective configuration of the subject matter of the invention.

In a further development of the winch, the latter comprises at least two side plates that are positioned perpendicular to the axis of rotation of the winch. In the side plate several spaced-apart radial slotted holes are arranged. In these slotted holes, stays are guided which extend in the direction of the axis of rotation of the winch from one side plate to the other side plate, or to both other side plates, so that thus each stay is received with one end in a slotted hole of one side plate and with the other end in a slotted hole of another side plate and by fastening elements, which are provided on each one of the side plates, are detachably and adjustably clamped along the length of the slotted hole. The totality of the stays spans a polygonal shape and the rope is placed in turns about the periphery of the polygon.

Due to the slidability of the stays within the slotted holes, advantageously the periphery of the spanned polygon can be changed which has the result that a different rope length is wound on per revolution of the shaft. Accordingly, an adjustment in regard to the rope length to be wound on can be carried out.

It is also possible to arrange several winches on a shaft whose stays are differently arranged. In this way, it can be achieved that with one revolution number of the shaft all ropes are wound onto the respective winch such that all exercise elements in the rest position are suspended at the same height. In this way, the required height for storing the exercise elements below a support structure, for example, a roof, is reduced in the best possible way.

Also, several shafts each provided with at least one winch can form the suspension system. By rotation of the shafts, a selection of exercise elements can be transferred from the position of use into a rest position and back. With this embodiment, it is possible to design different water parcourses. For example, the water parcourse can be arranged on different surface areas and in different expansion, depending on which area and how much of the surface area of the water surface is available. It is also possible to transfer water parcourses in different degrees of difficulty at different times into the position of use. Also possible are different theme scapes in which exercise elements are used that are designed according to different themes. By arrangement of a different selection of these elements, a simple change of these theme scapes is possible.

In an alternative embodiment, the suspension system comprises a pull rod system which is comprised of a pull rod and a pull rope wherein the pull rod by means of the pull rope is in operative connection with a drive. The rope is attached to the pull rod and extends across at least one deflection roller to the exercise element. By movement of the pull rod transverse to its length direction away from the deflection roller, the exercise element can be pulled upwardly. In the rest position, the pull rod has the greatest spacing relative to the deflection roller.

In one embodiment, a suspension system according to the invention can comprise at least one deflection roller which is not stationary and on which an exercise element is fastened. The rope extends from a fastening point on the support structure across the non-stationary deflection roller and at least one stationary deflection roller to the drive. The exercise element is thus movable by a travel length which is half as long as the travel length by which the drive pulls the rope.

In another arrangement of the suspension system, the rope extends from the exercise element across at least a stationary deflection roller and a non-stationary deflection roller, which is connected to the drive, to a fastening point on the support structure. The exercise element is movable by a travel length that is twice as long as the travel length by which the drive moves the non-stationary deflection roller.

An embodiment with non-stationary deflection rollers is also possible when a pull rod system is used. For example, even for tighter space conditions and thus tighter movement space available for the pull rod, low hanging exercise elements can be pulled up far.

The suspension system may comprise for each exercise element a different arrangement of the ropes and deflection rollers. For example, exercise elements which are arranged at different heights can be pulled up with the same pull rod without having the same height difference in the rest position. This is required in particular for a selection of exercise elements where, for example, one is arranged very high and another below the water surface.

In this context, the pull rod system can also be comprised of several pull rods and pull ropes wherein one group of exercise elements is respectively transferred by one pull rod system from the position of use into a rest position and back. Accordingly, an arrangement of a selection of exercise elements can be arranged in the position of use while the other exercise elements are in rest position.

In a further alternative embodiment of the suspension system, the support structure is arranged on guiding carriages on several vertical supports wherein the guiding carriages can be moved synchronously along the supports. Accordingly, the support structure and, together with it, the water parcourse with the exercise elements can be moved upwardly and downwardly by means of the operatively connected drive. Advantageously, the support structure can thus be moved also into a servicing or cleaning position in which it is easily accessible or the individual exercise elements can be easily exchanged.

Moreover, each one of the exercise elements or several exercise elements that are combined to a group can have associated therewith a rope winch for transferring the exercise elements from the position of use into a rest position. In this way, each individual exercise element can be moved to the desired height and the degree of difficulty for conquering each individual exercise element can be adjusted. A selection of exercise elements can be freely combined and arranged without paying attention in this context to grouping of elements in relation to shafts or pull systems.

The water parcourse with a suspension system comprises a mechanical drive blocking action in that a locking element is connected with the shaft, the pull rod system, or the support structure and blocks the shaft, the support structure, or the pull rod system against being moved. The locking element can be a bolt or a carabiner which is connected with the shaft, the pull rod system, or the support structure. By this connection, the shaft, the support structure, or the pull rod system is fixed in relation to its spatial position. Dropping of the water parcourse caused by failure of the drive is thus no longer possible.

In this connection, for example, the bolt can be driven through an opening in the shaft and support itself on a stationary part of the support structure. A hook or carabiner is conceivable also with which the ropes or the pull rope are attached to an eye in the position of non-use.

However, the drive blocking action can also be a clamping unit which clamps either the shaft or the pull rod so that also here, in case the drive fails, no movement can occur anymore. Also, a disk brake can function as a drive blocking action when it is interacting with brake discs fixedly connected to the shaft.

Securing of the position can also be realized by means of a self-locking action of the drive. In case of a defect of the drive, a movement is then not possible so that the exercise elements or the support structure cannot fall or drop due to gravity. Lowering is possible only by active intervention in the drive.

The drive of the suspension system can be an electric drive which is controlled by a control device. In this context, data can be input by an input device, electronically coupled with the control device for data transmission, and sent to the control device. In this way, the movement can be stopped or started, the speed and maximal positions can be determined. Also, an automatic raising of the exercise elements for the night or corresponding settings are conceivable.

Also, an input device can be provided that communicates wireless with the control device. This input device can also be a mobile terminal such as a smart phone or a tablet computer. For example, the movement of the exercise elements can be triggered by this terminal. This has the advantage that the operator can position himself such that he can overlook the entire surface area. He can also move while performing positioning so that he maintains at all times the best possible overview.

The control device can be connected to a data storage unit for data exchange. The exchanged data can comprise control programs that contain the predetermined settings for controlling the exercise elements for each one of the exercise elements.

Accordingly, a height position can be input from a lowest to a highest position in relation to the support structure. The control device processes the data and controls the drives in such a way that the exercise elements will be arranged at the predetermined height.

By means of the data storage unit, programs with height combinations for a plurality of exercise elements can be stored and retrieved also. For example, an individual configuration of the parcourse and its difficulty can be adjusted once and then can be reproduced in the same way in case of a rerun. In this way, in addition to different selections of exercise elements and difficulties, it is also possible to store user group-related parcourse. For example, a group can always encounter the same elements at the same height while another group encounters a different, but also always the same, arrangement.

Further embodiments as well as some of the advantages, which are associated with these and further embodiments, will become clear and better understood by means of the following detailed description with reference to the attached Figures. Objects or parts thereof which are substantially identical or similar may be provided with the same reference characters. The Figures are only schematic illustrations of an embodiment of the invention.

DESCRIPTION OF THE PREFERRED EMBODIMENTS

The device according to the invention relates to a water parcourse with a suspension system 1 wherein the water parcourse comprises exercise elements 2. Each one of the exercise elements 2 is arranged in a predetermined position of use below, on, or above a water surface 20 or in a predetermined rest position spaced apart from the water surface 20 and can be transferred from the position of use into the rest position and back.

Figure 1:
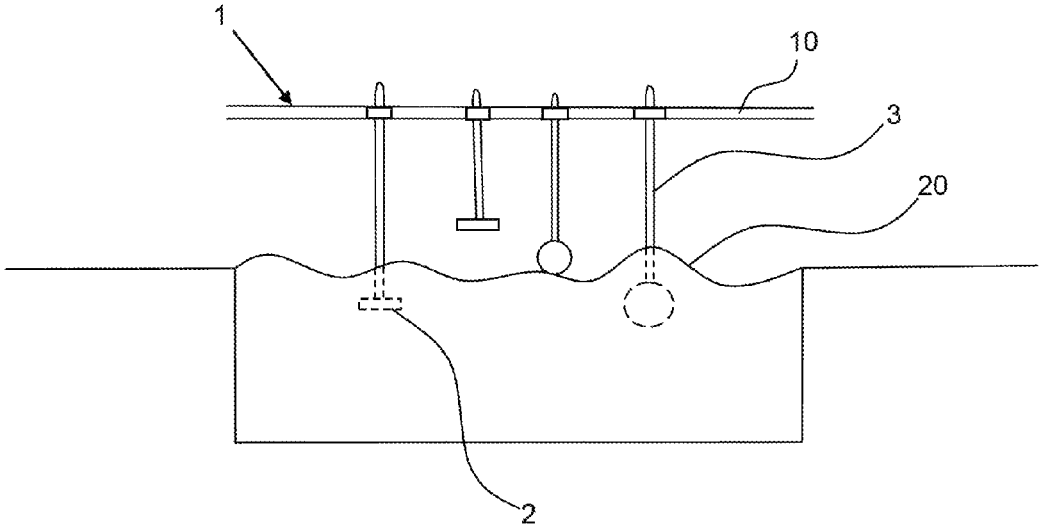
FIG. 1 shows a side view of a water parcourse with a suspension system in position of use.

FIG. 1 shows a water parcourse with a suspension system 1 in state of use. In this context, the exercise elements 2 are suspended at different heights. Depending on the design of the exercise elements 2, a different height can be predetermined. For example, there are exercise elements 2 that are arranged below the water surface 20 for diving underneath or through them; exercise elements 2 which are arranged on the water surface 20 and must be climbed across or on which one has to balance; exercise elements 2 that are hanging above the water surface 28 and are to be climbed up on; or also exercise elements 2 that project from below the water surface 20 out of the water.

Figure 2:
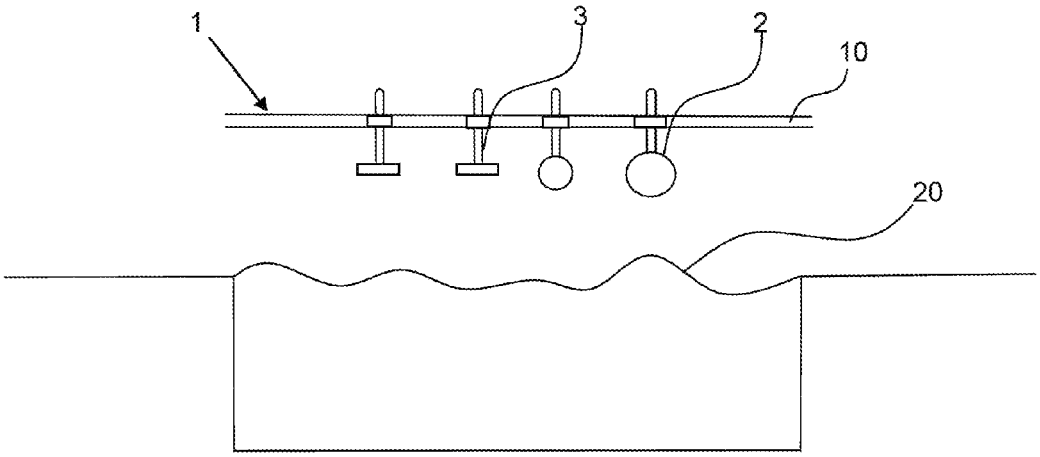
FIG. 2 shows a side view of the water parcourse with a suspension system of FIG. 1 in rest position.

FIG. 2 shows the water parcourse with the suspension system 1 of FIG. 1 in the rest position in which all exercise elements 2 are arranged spaced apart from the water surface 20. All exercise elements 2 are stowed away and are not in the way of swimmers or other bathers.

Figure 3:
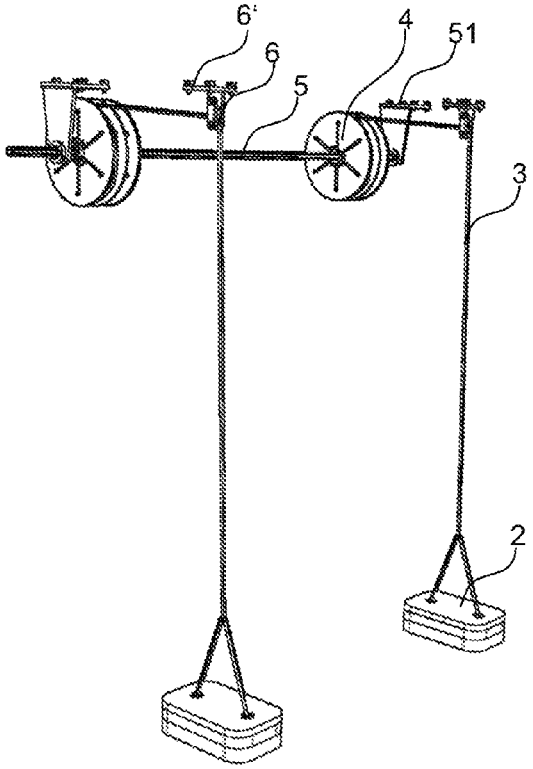
FIG. 3 shows a perspective view of a suspension system with a shaft and winches arranged thereon.
Figure 6:
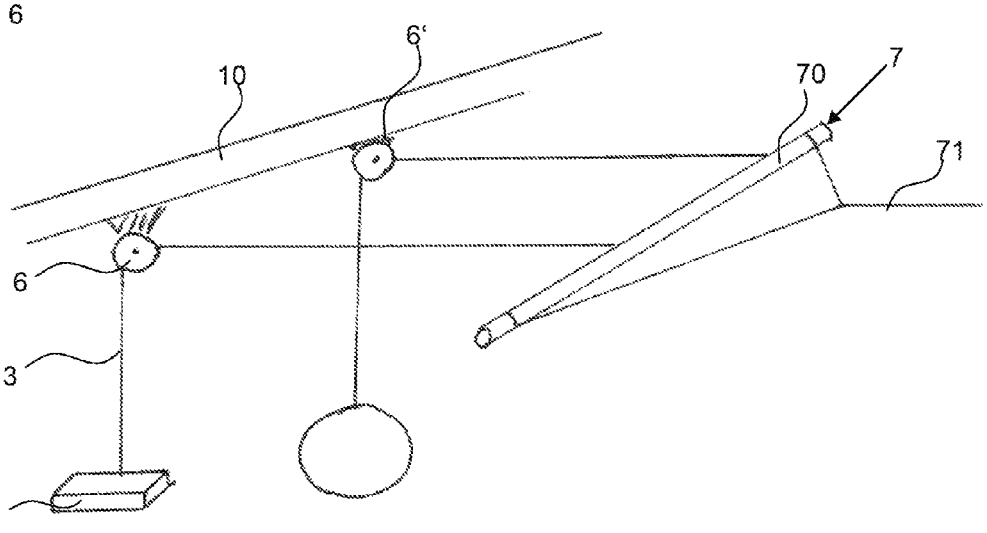
FIG. 6 shows a perspective view of a suspension system with a pull rod system and deflection rollers.
Figure 9:
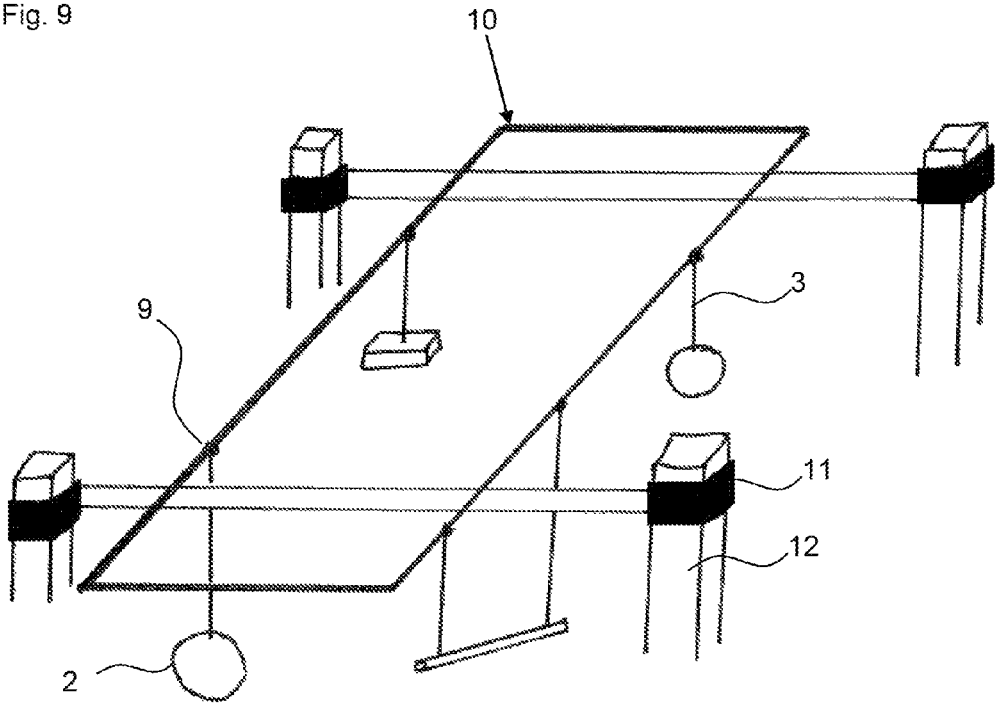
FIG. 9 shows a perspective view of a suspension system with movable support structure.

Each suspension system is comprised of a support structure 10 and a shaft 5 arranged thereat, a pull rod system 7, or one or several deflection rollers 6. These are shown in FIGS. 3, 6, and 9. In this context, the shaft 5, the pull rod system 7, or the support structure 10 itself is in operative connection with a drive A which drives the transfer between position of use and rest position.

FIG. 3 shows an embodiment of the suspension system 1 in which on a shaft 5 two winches 4 are arranged. The shaft is attached by means of fastening elements 51 on a support structure 10. This support structure 10 can be, for example, part of a ceiling or roof but can also be a frame that is specially constructed therefor. An exercise element 2 is arranged on each winch 4 by means of a rope 3.

When the shaft 5 is rotated, the winches 4 are also rotated at the same time and the rope 3 connected thereto is wound onto the winch 4. For this purpose, the winch 4 has stays 41 that support the rope 3 relative to the center of rotation.

In the illustrated embodiment of FIG. 3, the ropes 3 extend additionally about deflection rollers 6 which position the exercise elements 2 laterally displaced relative to winch 4 and which deflect the holding force and partially absorb it. These deflection rollers 6 can be arranged in different ways depending on the purpose which they fulfill and on the desired configuration of the water parcourse.

Not illustrated is the possibility of fastening an elongate exercise element 2 by means of two ropes 3 on two winches 4. Also, an exercise element 2 can be fastened to two ropes 3 and two winches 4 in order to limit the movement of the exercise element 2 during use.

Figure 4:
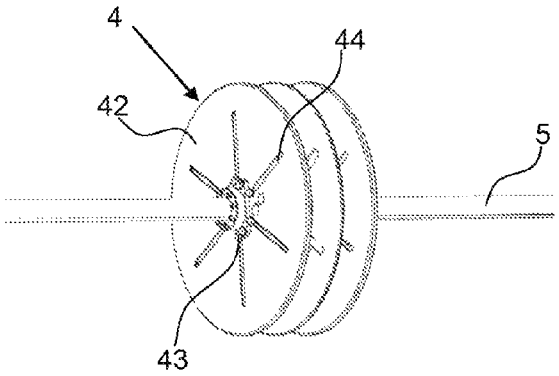
FIG. 4 shows a perspective view of a winch with a small adjusted diameter.
Figure 5:
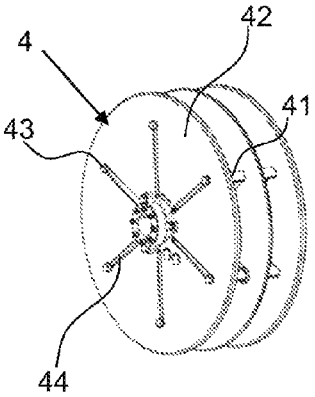
FIG. 5 shows a perspective view of the winch of FIG. 4 with large adjusted diameter.

A possible configuration of a winch 4 can be taken from FIGS. 4 and 5. Side plates 42 are shown, respectively, which delimit the area where the rope 3 can be wound. The side plates 42 have several radial elongate slots 44 which are spaced apart from each other. The stays 41, in direction of the axis of rotation of the winch 4, are arranged between two side plates 42 and are guided in slotted holes 44. Fastening elements 43 clamp the stays detachably and adjustably along the length of the slotted holes 44 in each one of the side plates 42 so that the totality of the stays 41 spans a polygonal shape and the rope 3 is resting in turns on the periphery of the polygon.

FIG. 4 shows a perspective detail view of a winch 4 in which the polygon spanned by the stays 41 is adjusted to the minimal periphery. The stays 41 are pushed in the slotted holes 44 all the way inwardly. FIG. 5 shows a perspective view of the winch 4 in which the polygon has been adjusted to the minimal periphery. Here, the stays 41 are adjusted in the slotted holes 44 all the way outwardly.

Due to the changeable periphery of the polygon onto which the rope 3 is wound, there are further application possibilities. For example, ropes of different lengths can be wound even though the winches 4 are seated on the same shaft 5 and thus carry out the same number of revolutions. When the stays 41 of the winches are positioned farther outwardly, the rope length, which is wound onto the winch 4 for each revolution, is greater than when the stays 41 are positioned father inwardly. Accordingly, in an ideal way the winch 4 can be adjusted to the respective rope length that is to be wound on so that in the rest position all exercise elements 2 are arranged at the same height as much as possible.

Even when an exercise element 2 is exchanged for another exercise element 2 that is arranged at a different height, the stays 41 of the winch 4 can simply be adjusted; it is not necessary to exchange the entire winch, and also all exercise elements 2 are again at the designated space in the rest position.

Not illustrated is a suspension system 1 that is comprised of several shafts 5 and winches 4 arranged thereon. The advantage of several shafts 5 that can be rotated independently from each other resides in that it is possible to bring only some of the exercise elements 2 into the position of use. In this context, it is not decisive whether these shafts 5 are driven by several drives A or, by couplings or other switching devices, are driven by one drive A.

FIG. 6 shows a suspension system 1 with a pull rod system 7 that transfers the exercise elements 2 between the positions. For this purpose, a pull rod 70 is in operative connection with a pull rope 71 with drive A. The drive A can be, for example, a rope winch. In this context, also a chain can be used instead of the pull rope 71. By means of ropes 3 one or several exercise elements 2 are attached to the pull rod 70. The ropes 3 are guided across one or several deflection rollers 6. In this context, the deflection rollers 6 serve for deflecting the ropes 3 so that the pulling force which is acting on the pull rod pulls the exercise elements 2 vertically upwardly. The pull rod 70 can be pulled in different directions. In the embodiment illustrated in FIG. 6, it is moved in horizontal direction away from the deflection rollers in order to pull the exercise elements 2 in upward direction. Conversely, the exercise elements 2 are lowered when the pull rod 70 is moved in the direction toward the deflection rollers.

Guiding of the ropes 3 about the deflection rollers 6 is possible in different ways and must be adjusted inter alia to the existing support structure 10. For example, ceiling parts or other existing supports and beams can be utilized for attachment of the deflection rollers 6.

Figure 7:
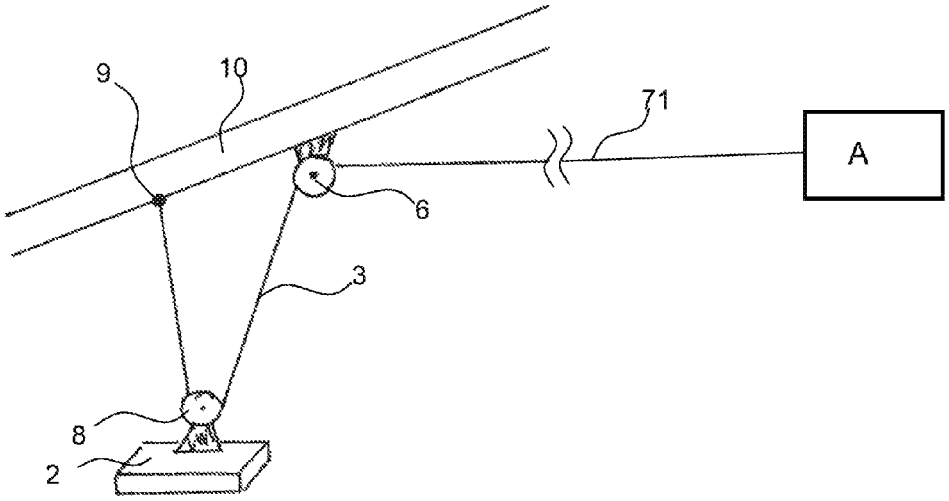
FIG. 7 shows a perspective view of an arrangement of deflection rollers.

The arrangement of non-stationary deflection rollers 8 can achieve a block and tackle effect with which different "transmission ratios" can be obtained. FIG. 7 shows a variant in which non-stationary deflection roller 8 is connected to a drive A. The rope 3 is guided from a fastening point 9 on the support structure 10 across this non-stationary deflection roller 8 and a deflection roller 6 stationarily fastened on the support structure 10 to the pull rope 71. When the pull rope 71 in this arrangement is pulled across a travel length, the non-stationary deflection roller 8, and together with it the exercise element 2, is moved by half the travel length upwardly.

Figure 8:
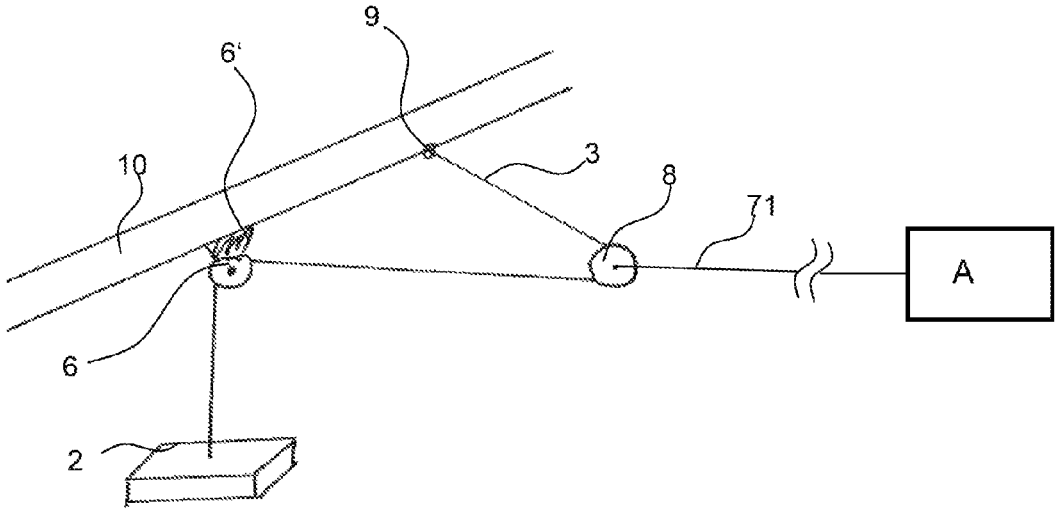
FIG. 8 shows a perspective view of another arrangement of deflection rollers.

In FIG. 8 another variant is illustrated in which the non-stationary deflection roller 8 is connected to drive A and is moved by means of the pull rope 71 and the drive A. The rope 3 is guided here from the exercise element 2 about a stationary deflection roller 6 connected to the support structure 10 and the non-stationary deflection roller 8 to a fastening point 9 on the support structure 10. When the pull rope 71 is pulled, the exercise element 2 is pulled up by twice the travel length.

When this arrangement is used in connection with a pull rod system 7, on the pull rod 70 several exercise elements 2 can be arranged and the ropes 3 extending away from them are guided in different variants so that for a predetermined movement of the pull rod 70 the exercise elements 2 are pulled up or lowered by different travel lengths. Accordingly, a variant can be selected in which the travel length is extended in case of an exercise element 2 which in the position of use is arranged low and a variant in which the travel length is shortened in case of a high hanging exercise element.

A pull rod system 7 that is comprised of several pull rods 70 and several pull ropes 71 is not illustrated. The individual pull rods 70 can thus be pulled to differently spaced positions so that different height differences can be overcome. The distribution of the exercise elements 2 onto several pull rods 70 can also be used so that not all exercise elements 2 must be moved at the same time into the position of use.

FIG. 9 shows a further embodiment of a suspension system in which the support structure 10 itself is changeable with respect to its height. For this purpose, the support structure 10 is fastened by guiding carriages 11 on supports 12. Four supports 12 and a substantially rectangular support structure 10 are shown. The support structure 10 can however also comprise a different expansion and can be guided on a different number of supports 12. The drive A here is in operative connection with the support structure 10 and moves the support structure 10 up and down along the supports 12. Together with the support structure 10 the exercise elements 2 also move to different heights.

The advantage of this embodiment is that the complete support structure 10 can be moved also to a position close to the ground or the water surface 20 so that servicing and cleaning work as well as exchange of exercise elements 2 is possible in a very simple way.

Here, the exercise elements 2 can also be arranged height-adjustable on the support structure 10 so that they can be adjusted to a suitable height. Also, a combination of the different illustrated embodiments is possible which combine the advantages of the individual embodiments.

In this context, the variant in which each exercise element 2 is movable by means of a separate drive A is not illustrated. This variant is the most flexible one and can adjust the exercise elements 2 to fit all requirements.

What is claimed is:

1. A water parcourse comprising:

a suspension system;

exercise elements attached to the suspension system such that the exercise elements each have a predetermined position of use below, on, or above a water surface and a predetermined rest position spaced apart from the water surface above the water surface, wherein the exercise elements are movable from the position of use into a rest position and from the rest position back into the position of use;

the suspension system comprising at least one support structure and one or more components connected to the at least one support structure and selected from the group consisting of:

a shaft comprising at least one winch rotatably arranged on the shaft, a pull rod system, and one or more deflection rollers, at least one drive operatively connected to the support structure or to the one or more components, wherein for moving the exercise elements from the position of use into the rest position and from the rest position into the position of use, a spatial position of the at least one support structure or of one of the components is changed by the at least one drive.

2. The water parcourse according to claim 1, wherein the suspension system comprises one or more fastening ropes, wherein the one or more fastening ropes attach the exercise elements to the support structure and the exercise elements are height-adjustable by the fastening ropes relative to the support structure.

3. The water parcourse according to claim 2, installed inside a building, wherein the support structure is part of a roof of the building.

4. The water parcourse according to claim 2, wherein the shaft comprising at least one winch and the one or more fastening ropes extend from the exercise elements to the at least one winch, wherein the shaft comprising the at least one winch is configured to wind the one or more fastening ropes.

5. The water parcourse according to claim 4, wherein the at least one winch comprises one or more side plates positioned perpendicular to an axis of rotation of the at least one winch, wherein the at least two side plates each comprise spaced-apart radial slotted holes, wherein the at least one winch comprises stays extending in a direction of the axis of rotation from a first one of the side plates to a second one of the side plates, wherein the stays each are connected with a first end in one of the slotted holes of the first side plate and with the second end in one of the slotted holes of the second side plate, wherein the first and second ends are clamped detachably and adjustably along a length of the slotted holes by fastening elements provided on the first and second side plates, wherein a totality of the stays span a polygonal shape and the fastening rope is wound in turns about a periphery of the polygon.

6. The water parcourse according to claim 1, wherein the pull rod system comprising a pull rod and a pull rope, wherein the pull rod is operatively connected by the pull rope to the at least one drive, wherein a fastening rope is connected with a first end to one of the exercise elements, is guided across at least one of the deflection rollers, and is attached with a second end to the pull rod.

7. The water parcourse according to claim 1, wherein the one or more deflection rollers include at least one non-stationary deflection roller and at least one stationary deflection roller, wherein a fastening rope is fastened with a first end at a fastening point to the support structure and extends across the at least one non-stationary deflection roller and the at least one stationary deflection roller to the at least one drive, wherein one of the exercise elements is fastened to the at least one non-stationary deflection roller.

8. The water parcourse according to claim 7, wherein between the at least one drive and the at least one stationary deflection roller a pull rod of the pull rod system is arranged.

9. The water parcourse according to claim 1, wherein the one or more deflection rollers include at least one non-stationary deflection roller and at least one stationary deflection roller, wherein the at least one non-stationary deflection roller is connected to the at least one drive, wherein a fastening rope is connected with a first end to one of the exercise elements, and extends across the at least one stationary deflection roller and the at least one non-stationary deflection roller, and is connected with a second end to a fastening point on the support structure so that the exercise element connected to the fastening rope can move along a travel length that is twice as long as a travel length by which the at least one non-stationary deflection roller is moved.

10. The water parcourse according to claim 1, further comprising vertical supports and guiding carriages that are arranged to be synchronously movable along the vertical supports, wherein the support structure is connected to the guiding carriages.

11. The water parcourse according to claim 1, wherein each one of the exercise elements has correlated therewith one of the winches of the shaft for transfer of the exercise elements from the position of use into the rest position and from the rest position into the position of use.

12. The water parcourse according to claim 1, wherein several of the exercise elements are combined to an exercise element group that has correlated therewith one of the winches of the shaft for transfer of the exercise elements of the exercise element group from the position of use into the rest position and from the rest position into the position of use.

13. The water parcourse according to claim 1, wherein the suspension system comprises a mechanical drive blocking action comprising a locking element that is connected with the shaft, the pull rod system, or the support structure and blocks the shaft, the support structure, or the pull rod system against being moved.

14. The water parcourse according to claim 1, wherein the at least one drive is self-locking.

15. The water parcourse according to claim 1, wherein the at least one drive comprises an electric drive, a control device controlling the electric drive, and an input device coupled electronically with the control device for data transmission.

16. The water parcourse according to claim 15, wherein the input device communicates wireless with the control device.

17. The water parcourse according to claim 16, wherein the input device is a mobile terminal.

18. The water parcourse according to claim 15, further comprising a data storage unit, wherein the control device is connected to the data storage unit for exchange of data, wherein the data comprise control programs which contain predetermined settings for each one of the exercise elements for controlling the exercise elements.

* * * * *